US006364640B1

(12) United States Patent
Nishio et al.

(10) Patent No.: US 6,364,640 B1
(45) Date of Patent: Apr. 2, 2002

(54) PUMP WITH A PULSATION SUPPRESSION DEVICE

(75) Inventors: Kiyoshi Nishio; Ryo Imanishi; Yoji Minato; Masayoshi Katsura; Hitoshi Kawamura; Makoto Fujii, all of Sanda (JP)

(73) Assignee: Nippon Pillar Packing Co., Ltd., Osaka (JP)

( * ) Notice: Subject to any disclaimer, the term of this patent is extended or adjusted under 35 U.S.C. 154(b) by 0 days.

(21) Appl. No.: 09/685,092

(22) Filed: Oct. 11, 2000

(30) Foreign Application Priority Data

Oct. 25, 1999 (JP) ..... 11-302485

(51) Int. Cl.[7] ..... F04B 11/00
(52) U.S. Cl. ..... 417/540
(58) Field of Search ..... 417/540, 437, 417/541, 542, 543; 303/87; 138/26; 73/277; 137/593, 508, 207

(56) References Cited

U.S. PATENT DOCUMENTS 4,024,061 A * 5/1977 Gatiss ..... 138/26
4,177,023 A * 12/1979 Kamiya et al. ..... 138/31
4,523,612 A * 6/1985 Kuklo ..... 138/26
4,537,216 A * 8/1985 Schwartz et al. ..... 137/514
5,098,263 A * 3/1992 Hattori et al. ..... 417/294
5,129,427 A * 7/1992 White et al. ..... 138/30
5,353,840 A * 10/1994 Paley et al. ..... 138/30
5,662,335 A * 9/1997 Larsen ..... 251/335.3
5,845,621 A * 12/1998 Robinson et al. ..... 123/456
6,053,712 A * 4/2000 Konishi et al. ..... 123/446
6,059,547 A * 5/2000 Konishi et al. ..... 123/446
6,186,171 B1 * 2/2001 Tanaka et al. ..... 137/565.34
6,322,338 B1 * 11/2001 Nishio ..... 138/30

* cited by examiner

*Primary Examiner*—Teresa Walberg
*Assistant Examiner*—Daniel Robinson
(74) *Attorney, Agent, or Firm*—Jones, Tullar & Cooper, P.C.

(57) ABSTRACT

The invention provides a pump with a pulsation suppression device which can further enhance the effect of suppressing pulsation.

According to the invention, in one side portion of a pump head wall 1 having inflow and outflow passages 2 and 3, a first bellows 7 which is driven so as to extend and contract by an air cylinder portion 14, and check valves 16*a* and 16*b* which alternately open and close a pump working chamber 9*a* formed in the first bellows 7 are disposed to constitute a reciprocal pump portion 4. In the other side portion of the pump head wall 1, a pulsation suppressing portion 5 is configured so as to have a second bellows 18 that is extendable and contractible, and that forms: a liquid chamber 20*a* which can temporarily store liquid that is to be discharged from the pump portion 4; and an air chamber 20*b* which is isolated from the liquid chamber 20*a*. The pulsation suppressing portion absorbs pulsation of the liquid which is discharged from the pump portion 4, by a change in the capacity of the liquid chamber 20*a*. The extension rate of the second bellows 18 is set to be larger than that of the first bellows 7.

8 Claims, 4 Drawing Sheets

PUMP WITH A PULSATION SUPPRESSION DEVICE

BACKGROUND OF THE INVENTION

1. Field of the Invention

The present invention relates to a pump with a pulsation suppression device, and more particularly to a pump with a pulsation suppression device which is preferably applied to, for example, circulating transportation of chemical liquids used in various processes such as surface washing on ICs in a semiconductor producing device or a liquid crystal display device.

2. Description of the Prior Art

As a pump with a pulsation suppression device of this kind, the assignee of the present invention has already proposed a configuration which is disclosed in, for example, Japanese Patent Publication Laying-Open No. 10-196521. In the proposed configuration, a pump head wall has inflow and out-flow passages for liquid, and an air-driven reciprocal pump portion and a pulsation suppressing portion are integrally disposed respectively on the sides of the pump head wall, so as to be opposed to each other.

The air-driven reciprocal pump portion comprises: a first bellows which is extendable and contractible in the axial direction in a casing that is disposed in one side portion of the pump head wall; an air cylinder portion which drives the first bellows so as to extend and contract; and a pump working chamber in which check valves are disposed inside the first bellows. The check valves are alternately opened and closed in accordance with the extending and contracting operations of the first bellows to suck and discharge the liquid.

On the other hand, the pulsation suppressing portion comprises: a second bellows which is disposed in a casing that is disposed in the other side portion of the pump head wall, so as to be extendable and contractible; a liquid chamber which is formed inside the second bellows, and which can temporarily store the liquid that is to be discharged from the pump working chamber via the discharge check valve; and an air chamber which is formed outside the second bellows so as to be isolated from the liquid chamber, and which is to be filled with air for suppressing pulsation. Pulsation due to the discharge pressure of the liquid which is discharged from the pump working chamber is reduced by a change in the capacity of the liquid chamber due to extension and contraction of the second bellows.

In a pump of this kind, the pump performs the pulsation suppression in the following manner. When the transported liquid discharged from the reciprocal pump portion and having a high pressure is to be received by the second bellows, the transported liquid is caused to flow into the liquid chamber of the second bellows while extending the second bellows, thereby absorbing the high pressure of the transported liquid. The transported liquid is temporarily stored in the liquid chamber of the second bellows, and then discharged from the out-flow passage while reducing the pressure of the transported liquid. In this case, the extending operation of the second bellows depends on the balance between the pressure of the transported liquid flowing into the liquid chamber of the second bellows, and the pressure of the air chamber which functions against the transported liquid pressure via the second bellows. Usually, a buffering function of a higher degree is obtained as the second bellows can extend more freely in accordance with the transported liquid pressure, and without being affected by the pressure rise of the air chamber due to the contraction of the air chamber corresponding to the extension displacement of the second bellows.

In the pump with a pulsation suppression device, the first bellows is formed by a fluororesin such as polytetrafluoroethylene which has excellent heat and chemical resistances so as to comply with circulating transportation of chemical liquids used in a semiconductor producing device or the like. Also the second bellows is formed by the same resin material as that described above, and has the same thickness as the first bellows so that the extension rates of the first and second bellows are strictly identical with each other. Therefore, the second bellows tends to extend and contract with laggingly following variation of the discharge pressure from the pump portion. In other words, the response property of the second bellows with respect to a pulsative pressure is low. As a result, the effect of suppressing pulsation cannot be sufficiently attained.

SUMMARY OF THE INVENTION

The present invention has been conducted in order to solve the problem.

It is an object of the invention to provide a pump with a pulsation suppression device which can further enhance the effect of suppressing pulsation.

The pump with a pulsation suppression device of the invention will be described with reference to the accompanying drawings. The reference numerals in the figures are used in this paragraph in order to facilitate the understanding of the invention, and the use of the reference numerals is not intended to restrict the contents of the invention to the illustrated embodiments.

The pump with a pulsation suppression device of the invention comprises: a pump head wall 1 having inflow and out-flow passages 2 and 3 for liquid; an air-driven reciprocal pump portion 4 comprising: a first bellows 7 which is made of a resin, and which is extendable and contractible in an axial direction in a casing 6 that is disposed in one side portion of the pump head wall 1; an air cylinder portion 14 which drives the first bellows 7 so as to extend and contract; and a pump working chamber 9*a* in which a check valve 16*a* for sucking and a check valve 16*b* for discharging are disposed inside the first bellows 7, the check valves being alternately opened and closed in accordance with the extending and contracting operations of the first bellows to suck and discharge the liquid; and a pulsation suppressing portion 5 comprising: a By second bellows 18 which is made of a resin, which is disposed in a casing 17 that is disposed in another side portion of the pump head wall 1, and which is extendable and contractible; a liquid chamber 20*a* which is formed inside the second bellows 18, and which can temporarily store the liquid that is to be discharged from the pump working chamber 9*a* via the discharge check valve 16*b*; and an air chamber 20*b* which is formed outside the second bellows 18 to be isolated from the liquid chamber 20*a*, and which is to be filled with air for suppressing pulsation, the pulsation suppressing portion causing pulsation due to a discharge pressure of the liquid which is discharged from the pump working chamber 9*a*, to be absorbed by a change in a capacity of the liquid chamber 20*a* due to the extending and contracting operations of the second bellows 18, and is characterized in that an extension rate of the second bellows 18 is set to be larger than an extension rate of the first bellows 7.

In this specification, the extension rate means the extension rate of an extending and contracting portion of each of the first and second bellows in the case where a pressure of a certain level is applied to the interior of the first or second bellow.

In the invention, the first and second bellows may be formed by a same resin material, and a thickness of the second bellows may be smaller than a thickness of the first bellows. In this case, preferably, the thickness ratio (second bellows/first bellows) of the first and second bellows is smaller than 1. As the same resin material of the first and second bellows, it is desirable to use polytetrafluoroethylene which has excellent heat and chemical resistances.

According to the thus configured pump with a pulsation suppression device of the invention, when the first bellows of the reciprocal pump portion is driven via the air cylinder portion so as to extend and contract, the suction and discharge check valves in the pump working chamber are alternately opened and closed, so that suction of the liquid from the liquid inflow passage into the pump working chamber, and discharge of the liquid from the pump working chamber into the liquid out-flow passage are repeated to conduct a predetermined pumping action. At this time, the liquid which is discharged from the pump working chamber via the discharge check valve flows out through the liquid chamber of the pulsation suppression portion into the out-flow passage. In this case, in a peak portion of the pulsation of the discharge pressure of the discharged liquid, the second bellows moves in the direction along which the capacity of the liquid chamber is increased, thereby absorbing the pressure, and, in a valley portion of the pulsation, the second bellows moves in the direction along which the capacity of the liquid chamber is reduced, so that the pressure of the discharged liquid is raised to absorb the pulsation. As a result, the liquid can be caused to flow out continuously and smoothly with a reduced degree of pulsation.

When the extension rate of the second bellows is set to be larger than the extension rate of the first bellows, particularly, the response property of the second bellows with respect to the pulsative pressure is remarkably improved, and therefore the effect of suppressing pulsation can be further enhanced.

DETAILED DESCRIPTION OF THE PREFERRED EMBODIMENT

An embodiment of the invention will be described with reference to FIGS. 1 and 2.

Figure 1:
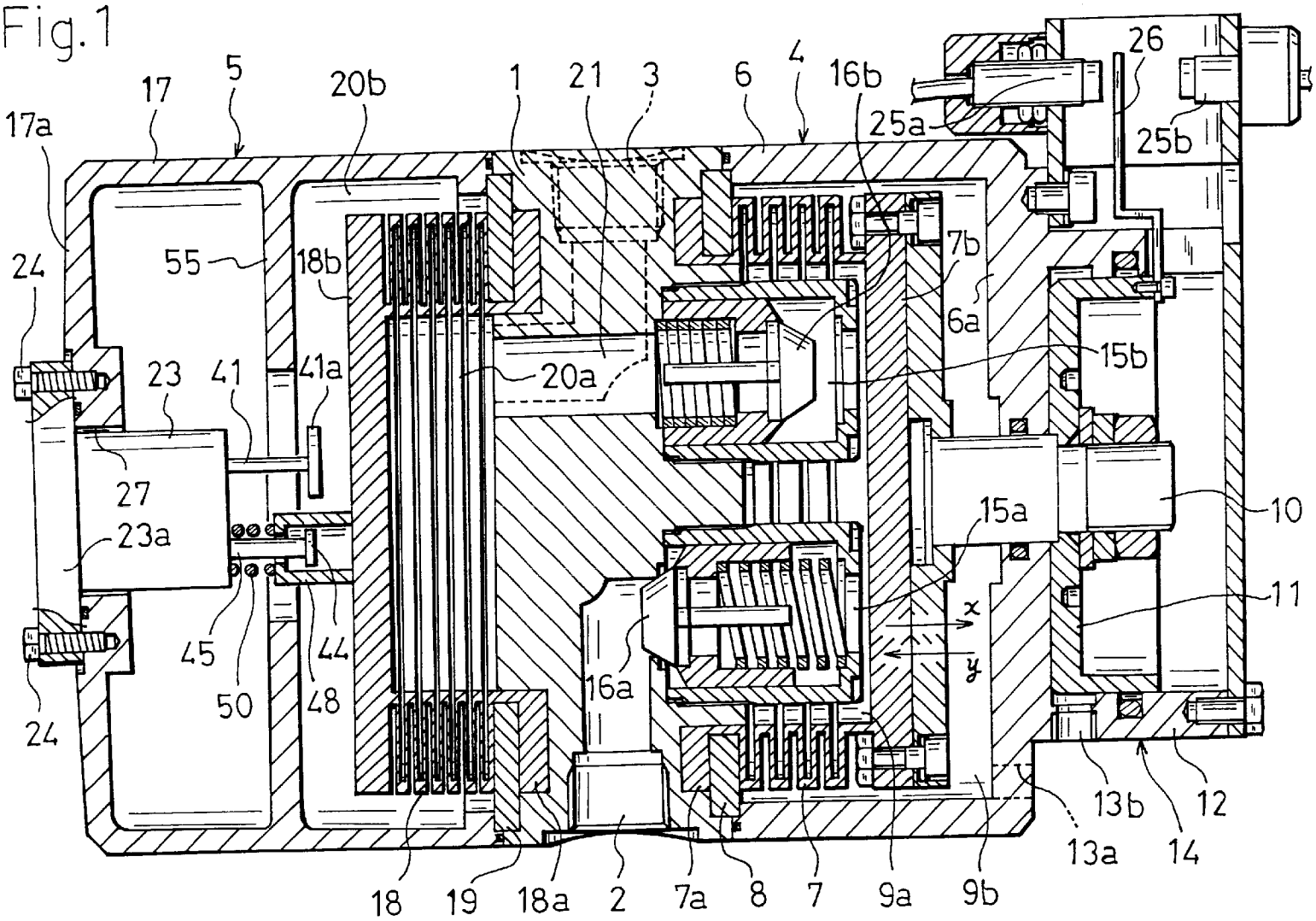
FIG. 1 is a longitudinal front section view of the whole of a pump with a pulsation suppression device of an embodiment of the invention.

Referring to FIG. 1, 1 denotes a pump head wall in which inflow and out-flow passages 2 and 3 for liquid are formed. An air-driven reciprocal pump portion 4 and a pulsation suppressing portion 5 are integrally disposed respectively on the sides of the pump head wall 1 so as to be opposed to each other. A bottomed cylindrical casing 6 is fixedly continuously disposed in one side portion of the pump head wall 1. In the casing 6, a first bottomed cylindrical bellows 7 which is extendable and contractible in the axial direction of the cylinder of the casing is disposed. An opening peripheral edge 7*a* of the first bellows 7 is airtightly pressingly fixed to one side face of the pump head wall 1 by an annular fixing plate 8. According to this configuration, the inner space of the casing 6 is hermetically partitioned into a pump working chamber 9*a* inside the first bellows 7, and a pump operating chamber 9*b* outside the first bellows 7.

A cylinder body 12 in which a piston body 11 that is fixedly coupled via a coupling member 10 to a closed end member 7*b* of the first bellows 7 is slidably housed is fixed to the outside of a bottom wall portion 6*a* of the casing 6. Pressurized air which is fed from a pressurized air supplying device (not shown) such as a compressor is supplied to the interior of the cylinder body 12, or the pump operating chamber 9*b* via air holes 13*a* and 13*b* formed in the cylinder body 12 and the bottom wall portion 6*a* of the casing 6, thereby configuring an air cylinder portion 14 which drives the first bellows 7 so as to extend and contract.

Proximity sensors 25*a* and 25*b* are attached to the air cylinder portion 14, and a sensor sensing plate 26 is attached to the piston body 11. In accordance with the reciprocal motion of the piston body 11, the sensor sensing plate 26 alternately approaches the proximity sensors 25*a* and 25*b*, whereby the supply of the pressurized air which is fed from the pressurized air supplying device (not shown), into the cylinder body 12, and that into the pump operating chamber 9*b* are automatically switched over.

A suction port 15*a* and a discharge port 15*b* which are opened in the pump working chamber 9*a* communicate with the inflow passage 2 and the out-flow passage 3, respectively. A suction check valve 16*a* and a discharge check valve 16*b* which are alternately opened and closed in accordance with extending and contracting operations of the first bellows 7 are disposed in the suction port 15*a* and the discharge port 15*b*, respectively. The above-mentioned components constitute the reciprocal pump portion 4.

A bottomed cylindrical casing 17 is fixedly continuously disposed in the other side portion of the pump head wall 1 so as to be coaxial with the casing 6. In the casing 17 also, a second bottomed cylindrical bellows 18 which is extendable and contractible in the axial direction of the cylinder of the casing 17 is disposed so as to be opposed to the first bellows 7 of the pump portion 4. An opening peripheral edge 18*a* of the second bellows 18 is airtightly pressingly fixed to another side face of the pump head wall 1 by an annular fixing plate 19. According to this configuration, the inner space of the casing 17 is partitioned into a liquid chamber 20*a* which is formed inside the second bellows 18, and which temporarily stores the liquid that is to be discharged via the discharge check valve 16*b* and a communication passage 21 formed in the thickened portion of the pump head wall 1, and an air chamber 20*b* which is formed outside the second bellows 18, and which is to be filled with air for suppressing pulsation.

The above-mentioned components constitute the pulsation suppressing portion 5 which causes pulsation due to the discharge pressure of the liquid discharged from the pump working chamber 9*a* of the pump portion 4, to be absorbed and damped by a change in the capacity of the liquid chamber 20*a* due to extension and contraction of the second bellows 18.

An opening 27 is formed in the vicinity of the center of the outer face of a bottom wall 17*a* of the casing 17 in the pulsation suppressing portion 5. A valve case 23 having a flange 23*a* is fitted into the opening 27. The flange 23*a* is detachably fastened to the outer side of the bottom wall 17*a* by bolts 24 or the like.

Figure 2:
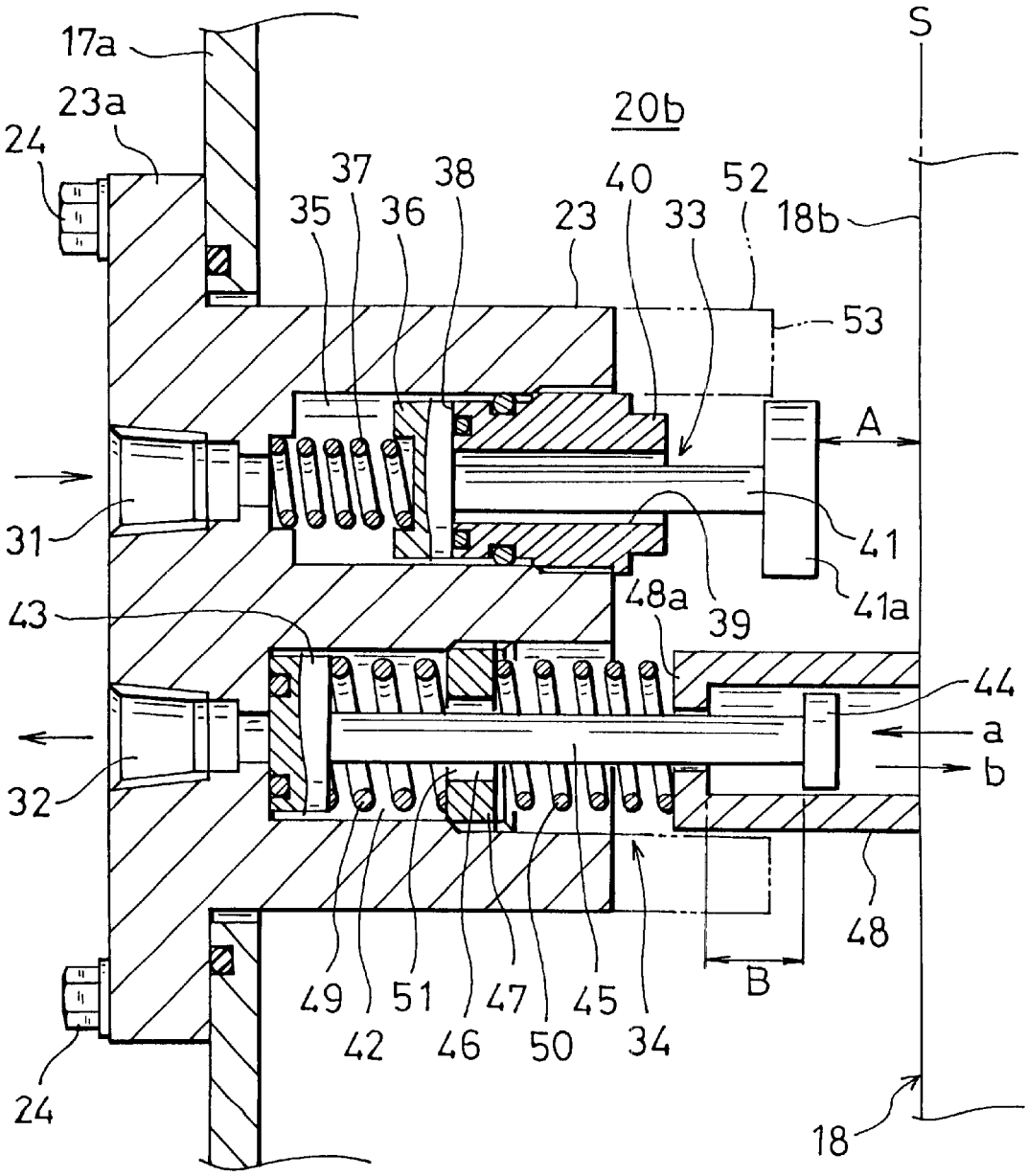
FIG. 2 is an enlarged longitudinal front section view of an air supply and discharge switching valve mechanism of the pump with a pulsation suppression device of FIG. 1.

As shown in FIG. 2, an air supply port 31 and an air discharge port 32 are formed in the valve case 23 so as to be juxtaposed in parallel. An automatic air supply valve mechanism 33 is disposed in the air supply port 31. When the capacity of the liquid chamber 20*a* is increased to exceed a predetermined range, the air supply valve mechanism supplies air of a pressure which is equal to or higher than the maximum pressure of the transported liquid, into the air chamber 20*b*, thereby raising the filling pressure in the air chamber 20*b*. An automatic air discharge valve mechanism 34 is disposed in the air discharge port 32. When the capacity of the liquid chamber 20*a* is decreased to exceed the predetermined range, the automatic air discharge valve mechanism 34 discharges air from the air chamber 20*b* to lower the filling pressure in the air chamber 20*b*.

The automatic air supply valve mechanism 33 comprises: an air supply valve chamber 35 which is formed in the valve case 23 so as to communicate with the air supply port 31; an air supply valve element 36 which is slidable in the valve chamber 35 along the axial direction of the chamber to open and close the air supply port 31; a spring 37 which always urges the valve element 36 to the closing position; a guide member 40 having, in an inner end portion, a valve seat 38 for the air supply valve element 36, and a through hole 39 through which the air supply valve chamber 35 and the air chamber 20*b* communicate with each other, the guide member being screwingly fixed to the valve case 23; and a valve operating rod 41 which is slidably passed through a through hole 39 of the guide member 40. Under the condition where the second bellows 18 is in the reference position S in a mean pressure state of the liquid pressure in the liquid chamber 20*a*, the valve element 36 is in close contact with the valve seat 38 of the guide member 40, for the air supply valve element 36 to close the air supply port 31, and an end portion 41*a* of the valve operating rod 41 which faces the air chamber 20*b* is separated from a closed end portion 18*b* of the second bellows 18 by a stroke A.

By contrast, the automatic air discharge valve mechanism 34 comprises: an air discharge valve chamber 42 which is formed in the valve case 23 so as to communicate with the air discharge port 32; an air discharge valve element 43 which is slidable in the valve chamber 42 along the axial direction of the chamber to open and close the air discharge port 32; an air discharge valve rod 45 in which the valve element 43 is disposed at the tip end, and a flange 44 is disposed at the rear end; a spring receiver 47 screwingly fixed into the air discharge valve chamber 42, and having a through hole 46 through which the air discharge valve rod 45 is passed through; a cylindrical slider 48 through which a rear end portion of the air discharge valve rod 45 is slidably passed, and which is locked by the flange 44; a closing spring 49 which is disposed between the valve element 43 and the spring receiver 47; and an opening spring 50 which is disposed between the spring receiver 47 and the slider 48. The inner diameter of the through hole 46 of the spring receiver 47 is larger than the shaft diameter of the air discharge valve rod 45, so as to form a gap 51 between the two components. The air discharge valve chamber 42 and the air chamber 20*b* communicate with each other via the gap 51. Under the state where the second bellows 18 is in the reference position S, the valve element 43 closes the air discharge port 32, and the flange 44 at the rear end of the air discharge valve rod 45 is separated from the inner face of a closing end portion 48*a* of the slider 48 by a stroke B.

As indicated by the phantom line 52 in FIG. 2, an end of the valve case 23 on the side of the air chamber may be elongated in the direction directed to the interior of the air chamber 20*b*, and a stopper 53 may be disposed at the end of the elongated portion. When the second bellows 18 is moved in the direction of expanding the liquid chamber 20*a* in excess of the predetermined stroke A to operate the valve operating rod 41, the stopper restricts a further movement of the second bellows 18. In this case, a stopper wall 55 (see FIG. 1) which is protruded from the inner face of the casing 17 into the air chamber 20*b* for the same objective may be omitted.

Next, the operation of the thus configured pump with a pulsation suppression device will be described.

The pressurized air which is fed from the pressurized air supplying device (not shown) such as a compressor is supplied to the interior of the cylinder body 12 of the air cylinder portion 14 in the reciprocal pump portion 4, via the air hole 13*b*, to move the piston body 11 and the coupling member 10 in the direction x in FIG. 1. The transported liquid in the inflow passage 2 is sucked into the pump working chamber 9*a* via the suction check valve 16*a*. When the pressurized air is supplied into the pump operating chamber 9*b* of the air cylinder portion 14 via the air hole 13*b* and air is discharged through the air hole 13*b* to cause the first bellows 7 to contract in the direction y in FIG. 1, the transported liquid which has been sucked into the pump working chamber 9*a* is discharged via the discharge check valve 16*b*. When the first bellows 7 of the reciprocal pump portion 4 is driven via the air cylinder portion 14 so as to extend and contract as described above, the suction and discharge check valves 16*a* and 16*b* are alternately opened and closed, so that suction of the liquid from the inflow passage 2 into the pump working chamber 9*a*, and discharge of the liquid from the pump working chamber 9*a* into the out-flow passage 3 are repeated to conduct a predetermined pumping action. When the transported liquid is fed to a predetermined portion by the operation of the reciprocal pump portion 4, the pump discharge pressure generates pulsation due to repetition of peak and valley portions.

The transported liquid discharged from the pump working chamber 9*a* of the pump portion 4 via the discharge check valve 16*b* is passed through the communication passage 21 and then sent into the liquid chamber 20*a* in the pulsation suppressing portion 5. The liquid is temporarily stored in the liquid chamber 20*a*, and thereafter discharged into the out-flow passage 3. When the discharge pressure of the transported liquid is in a peak portion of a discharge pressure curve, the transported liquid causes the second bellows 18 to extend so as to increase the capacity of the liquid chamber 20*a*, and hence the pressure of the liquid is absorbed. At this time, the flow quantity of the transported liquid flowing out from the liquid chamber 20*a* is smaller than that of the liquid supplied from the reciprocal pump portion 4.

By contrast, when the discharge pressure of the transported liquid comes to a valley portion of the discharge pressure curve, the pressure of the transported liquid becomes lower than the filling pressure of the air chamber 20*b* which is compressed by extension of the second bellows 18, and hence the second bellows 18 contracts. At this time, the flow quantity of the transported liquid flowing from the reciprocal pump portion 4 into the liquid chamber 20*a* is larger than that of the liquid flowing out from the liquid chamber 20*a*. This repeated operation, i.e., the capacity change of the liquid chamber 20*a* causes the pulsation to be absorbed and suppressed.

When the discharge pressure of the reciprocal pump portion 4 is varied in the increasing direction during such an operation, the capacity of the liquid chamber 20*a* is increased by the transported liquid, with the result that the second bellows 18 largely extends. When the amount of extension of the second bellows 18 exceeds the predetermined range A, the closed end portion 13*b* of the second bellows 18 pushes the valve operating rod 41 toward the valve chamber. This causes the air supply valve element 36 of the automatic air supply valve mechanism 33 to be opened against the force of the spring 37, and air of the high pressure is supplied into the air chamber 20*b* through the air supply port 31, with the result that the filling pressure of the air chamber 20*b* is raised. Therefore, the amount of extension of the second bellows 18 is restricted so as not to exceed the stroke A, whereby the capacity of the liquid chamber 20*a* is suppressed from being excessively increased. When the stopper 53 is disposed at the end of the valve case 23 on the side of the air chamber, the closed end portion 18*b* of the second bellows 18 abuts against the stopper 53, so that the second bellows 18 can be surely prevented from excessively extending. This is advantageous to prevent the second bellows from being damaged. In accordance with the rise of the filling pressure in the air chamber 20*b*, the second bellows 18 contracts toward the reference position S. Therefore, the valve operating rod 41 separates from the closed end portion 18*b* of the second bellows 18, and the air supply valve element 36 returns to the closing position, so that the filling pressure in the air chamber 20*b* is fixed to an adjusted state.

By contrast, when the discharge pressure of the reciprocal pump portion 4 is varied in the decreasing direction, the capacity of the liquid chamber 20*a* is decreased by the transported liquid, with the result that the second bellows 18 largely contracts. When the amount of contraction of the second bellows 18 exceeds the predetermined range B, the slider 48 of the automatic air discharge valve mechanism 34 is moved in the contraction direction b of the second bellows 18 by the urging function of the opening spring 50, in accordance with the movement of the closed end portion 18*b* of the second bellows 18 in the contraction direction b, and the inner face of the closing end portion 48*a* of the slider 48 is engaged with the flange 44 of the air discharge valve rod 45. This causes the air discharge valve rod 45 to be moved in the direction b and the valve element 43 opens the air discharge port 32. As a result, the filled air in the air chamber 20*b* is discharged into the atmosphere through the air discharge port 32, and the filling pressure of the air chamber 20*b* is lowered. Therefore, the amount of contraction of the second bellows 18 is restricted so as not to exceed the stroke B, whereby the capacity of the liquid chamber 20*a* is suppressed from being excessively decreased. In accordance with the reduction of the filling pressure in the air chamber 20*b*, the second bellows 18 extends toward the reference position S. Therefore, the slider 48 is pushed by the closed end portion 18*b* of the second bellows 18, to compress the opening spring 50 while moving in the direction a. The valve element 43 again closes the air discharge port 32 by the urging function of the closing spring 49, whereby the filling pressure in the air chamber 20*b* is fixed to the adjusted state. As a result, pulsation is efficiently absorbed and the amplitude of pulsation is suppressed to a low level, irrespective of variation of the discharge pressure from the pump working chamber 9*a* of the reciprocal pump portion 4.

In the pump with a pulsation suppression device of the embodiment, the reciprocal pump portion 4 comprises the single first bellows 7. Alternatively, the reciprocal pump portion 4 may be similarly applied to a type in which, as shown in FIG. 3, a pair of first bellows 7 are disposed.

Figure 3:
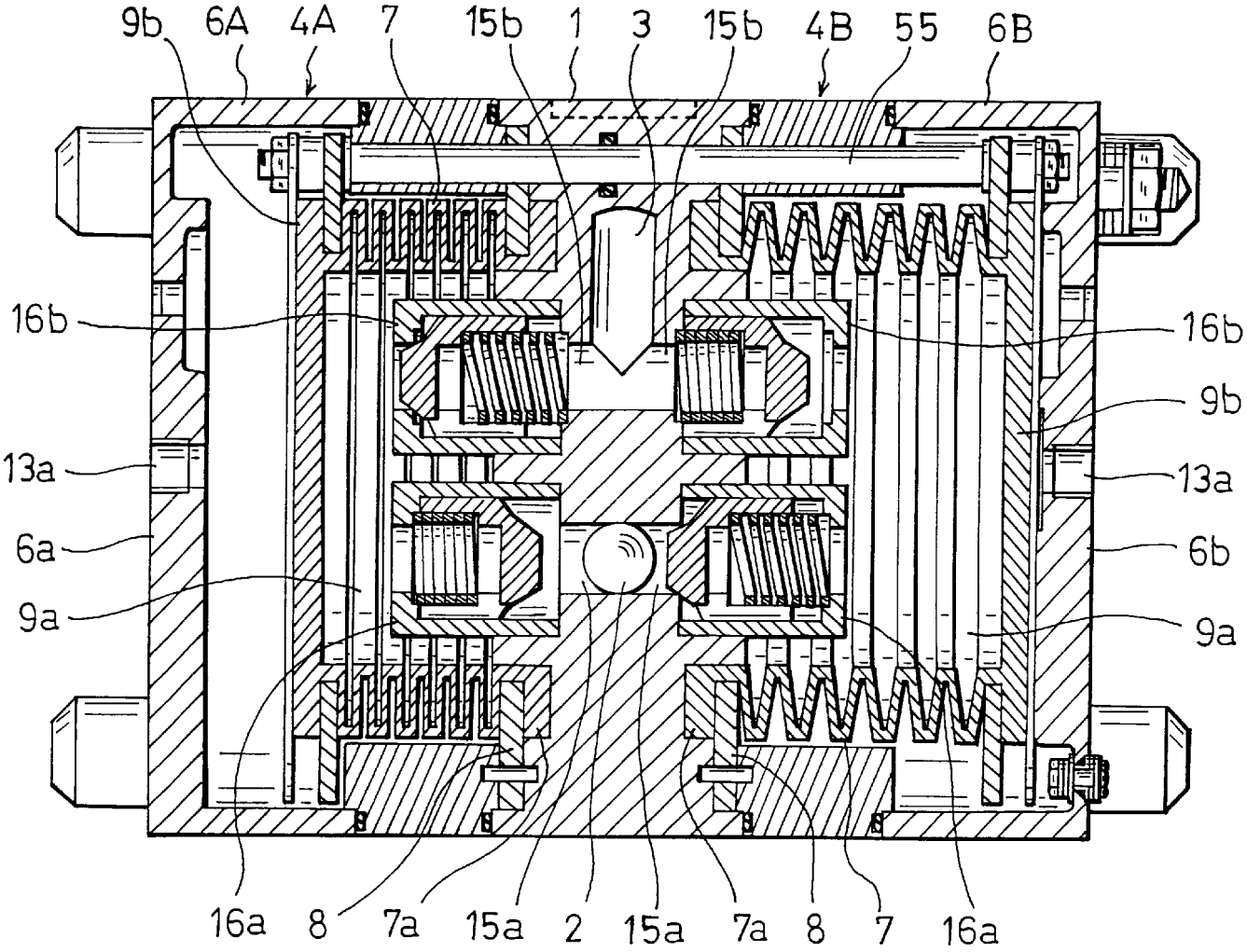
FIG. 3 is a longitudinal front section view of a reciprocal pump portion of a pump with a pulsation suppression device of another embodiment of the invention.

In the pump with a pulsation suppression device of FIG. 3, a pair of first cylindrical bellows 7 which are extendable and contractible in the same direction are disposed so as to be opposed to each other, in cylindrical casings 6A and 6B which are fixedly continuously disposed on both the side portions of a pump head wall 1 having inflow and out-flow passages 2 and 3 for liquid, respectively. Opening peripheral edges 7*a* of the pair of first bellows 7 are airtightly pressingly fixed to the pump head wall 1 via annular fixing plates 8. According to this configuration, a pair of pump portions 4A and 4B are configured by hermetically partitioning the inner spaces of the casings 6A and 6B into pump working chambers 9*a*, and pump operating chambers 9*b*.

In the pair of pump portions 4A and 4B, the paired first bellows 7 are interlockingly coupled to each other via a plurality of connecting rods 55 which are passed through the pump head wall 1 and arranged in the circumferential direction, in such a manner that, when one of the first bellows 7 contracts, the other first bellows 7 extends. Suction ports 15*a* and discharge ports 15*b* which are opened in the pump working chambers 9*a* of the pair of pump portions 4A and 4B communicate with the inflow passage 2 and the out-flow passage 3, respectively. Suction check valves 16*a* are disposed in the suction ports 15*a*, respectively, and discharge check valves 16*b* are disposed in the discharge ports 15*b*, respectively. Air holes 13*a* which alternately supply pressurized air to the pump operating chambers 9*b* at intervals of a predetermined time period are formed on the bottom wall portions 6*a* and 6*b* of the casings 6A and 6B.

In this configuration, the pressurized air which is fed from the pressurized air supplying device (not shown) such as a compressor is alternately supplied to the pump operating chambers 9*b* via the air holes 13*a* at the predetermined time intervals, whereby the pair of the first bellows 7 are driven via the connecting rods 55 to reversibly extend and contract so that the pair of pump portions 4A and 4B are caused to alternately perform the suction and discharge strokes. As a result, the pumping action is performed to discharge the fluid flowing from the inflow passage 2 into the pump working chambers 9*a*, to the out-flow passage 3 in a substantially continuous manner.

Figure 4:
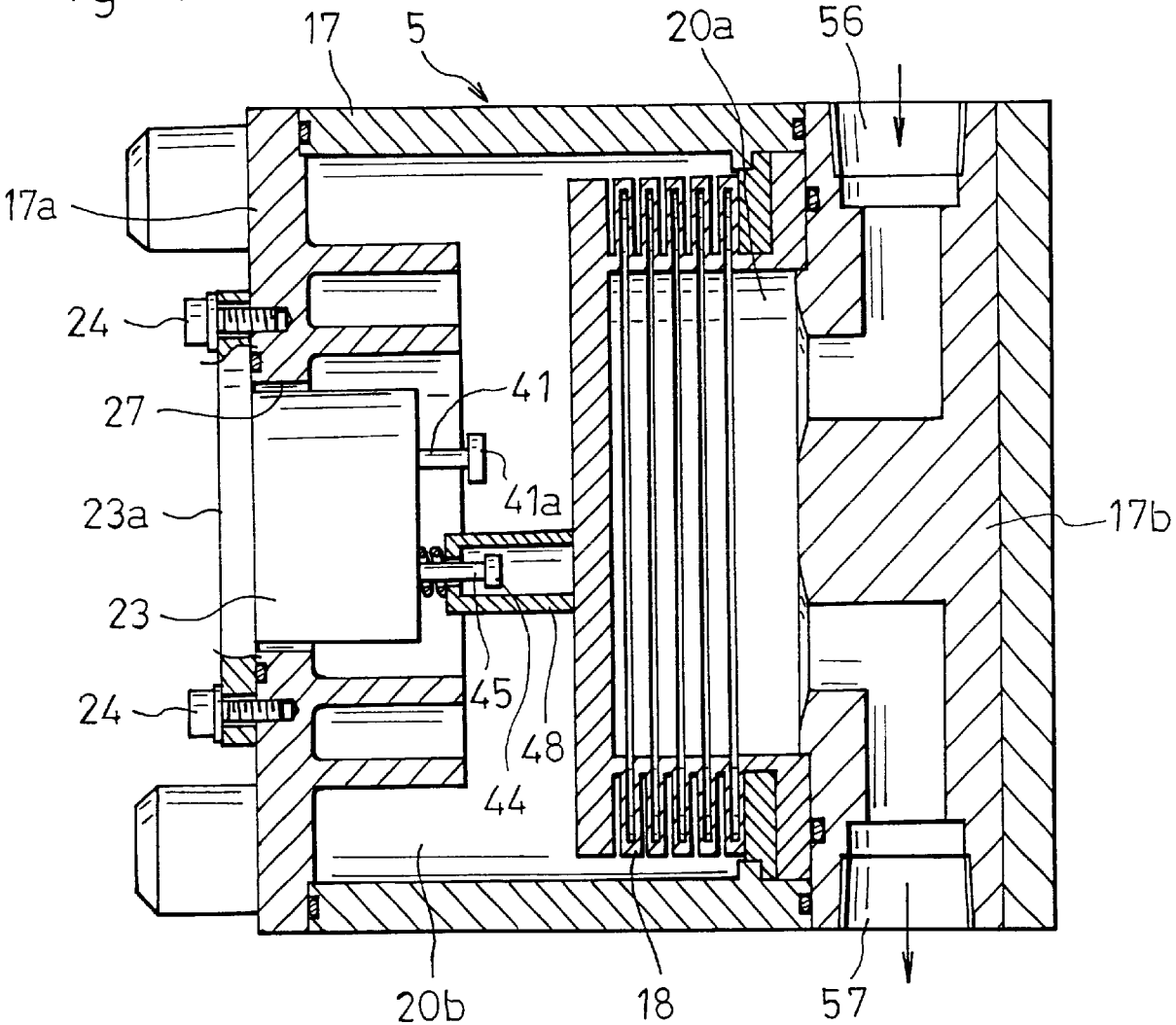
FIG. 4 is a longitudinal front section view showing a state where a pulsation suppressing portion of the pump with a pulsation suppression device of FIG. 3 is separated from the reciprocal pump portion.

A pulsation suppressing portion 5 shown in FIG. 4 is integrally joined to the reciprocal pump portions 4A and 4B having the pair of the first bellows 7. In a side wall 17*b* of a casing 17 which has a substantially same shape as the casing 17 of FIG. 1, the pulsation suppressing portion 5 has: an inflow port 56 which is communicatingly connected to the discharge ports 15*b* of the reciprocal pump portions 4A and 4B; and an out-flow port 57 which is communicatingly connected to the out-flow passages 3 of the reciprocal pump portions 4A and 4B. A liquid chamber 20*a* which receives the transported liquid from the discharge ports 15*b* of the reciprocal pump portions 4A and 4B via the inflow port 56, temporarily stores the liquid, and then allows the liquid to flow out from the out-flow port 57 is formed in one side portion of the casing 17. An air chamber 20*b* is formed in the other side portion of the casing 17. The liquid chamber 20*a* and the air chamber 20*b* are isolated from each other by a second bellows 18. An opening 27 is formed in the other side wall 17*a* of the casing 17. A valve case 23 in which mechanisms identical with the automatic air supply valve mechanism 33 and the automatic air discharge valve mechanism 34 are disposed is attached to the opening 27 by bolts 24 or the like. The configurations and functions of the pulsation suppressing portion 5, the automatic air supply valve mechanism 33, and the automatic air discharge valve mechanism 34 are identical with those of the embodiment described above, and hence their description is omitted.

In the pump with a pulsation suppression devices which are configured as the above embodiments, the invention is characterized in that the extension rate of the second bellows 18 is set to be larger than that of the first bellows 7.

Specifically, each of the first and second bellows 7 and 18 is formed by a fluororesin which has excellent heat and chemical resistances, such as PTFE (polytetrafluoroethylene) or PFA (perfluoroalkoxy), preferably, by polytetrafluoroethylene. In this case, the thickness (for example, 1 to 1.5 mm) of the second bellows 18 is set to be smaller than the thickness (for example, 2.0 to 2.5 mm) of the first bellows 7, so that the thickness ratio (thickness of the second bellows/thickness of the first bellows) of the first and second bellows 7 and 18 is set to be smaller than 1, and the extension rate ratio (extension rate of the second bellows/extension rate of the first bellows) of the first and second bellows 7 and 18 is set to have a value which is larger than 1.

Comparison tests on the pulsation amplitude depending on the extension rate ratio of the first and second bellows 7 and 18 were conducted. As a result, in each of examples 1, 2, and 3 in which the extension rate ratios are 2, 3, and 4, respectively, the pulsation amplitude was 15 (%); in example 4 in which the extension rate ratio is 6, the pulsation amplitude was 13 (%); and, in example 5 in which the extension rate ratio is 8 and 10, the pulsation amplitude was 12 (%). Namely, excellent results that, in all of examples 1 to 5, the pulsation amplitudes can be suppressed to a small value on the average were obtained. In this case, when the extension rate ratio is larger than 10, the maximum elongation length of the second bellows 18 becomes large to cause the size of the pulsation suppressing portion 5 to be increased. Therefore, this is not preferable.

By contrast, in comparative example 1 in which the extension rate ratio is 0.6, the pulsation amplitude was 60 (%), and, in comparative example 2 in which the extension rate ratio is 0.8, the pulsation amplitude was 30 (%). In both of comparative examples 1 and 2, the pulsation amplitude was large, or unsatisfactory results were obtained.

The extension rate ratio is obtained by the extension rate ratio=(extension rate of the second bellows/extension rate of the first bellows), and the pulsation amplitude is obtained by the pulsation amplitude (%)={((maximum discharge pressure—minimum discharge pressure)/average discharge pressure}×100.

Also comparison tests on the pulsation amplitude depending on the thickness ratio of the first and second bellows 7 and 18 were conducted. As a result, in each of examples 1, 2, and 3 in which the thickness ratios are 1.0, 0.9, and 0.7, respectively, the pulsation amplitude was 15 (%); in example 4 in which the thickness ratio is 0.5, the pulsation amplitude was 14 (%); in example 5 in which the thickness ratio is 0.3, the pulsation amplitude was 13 (%); and, in example 6 in which the thickness ratio is 0.1, the pulsation amplitude was 12 (%). Namely, excellent results that, in all of examples 1 to 6, the pulsation amplitudes can be suppressed to a small value on the average were obtained.

By contrast, in comparative example 1 in which the thickness ratio is 1.1, the pulsation amplitude was 20 (%); in comparative example 2 in which the thickness ratio is 1.2, the pulsation amplitude was 35 (%); and, in comparative example 3 in which the thickness ratio is 1.3, the pulsation amplitude was 70 (%). In all of the comparative examples, the pulsation amplitude was large, or unsatisfactory results were obtained.

The thickness ratio is obtained by the thickness ratio =(thickness of the second bellows/thickness of the first bellows), and the pulsation amplitude is obtained by the pulsation amplitude (%)={(maximum discharge pressure—minimum discharge pressure)/average discharge pressure)}×100.

As means for setting the extension rate of the second bellows 18 to be larger than that of the first bellows 7, in addition to the above-mentioned means for forming the first and second bellows 7 and 18 by the same resin material, and making the thickness of the second bellows 18 to be smaller than that of the first bellows 7, means for forming the second bellows 18 by a resin material which is larger in extension rate than and different from that forming the first bellows 7 may be used. For example, the first bellows 7 is formed by PTFE (polytetrafluoroethylene), and the second bellows 18 is formed by rubber.

The entire disclosure of Japanese Patent Application No. 11-302485 filed on Oct. 25, 1999 including specification, claims, drawings and summary are incorporated herein by reference in its entirety.

What is claimed is:

1. A pump with a pulsation suppression device comprising:

a pump head wall having inflow and out-flow passages for liquid;

an air-driven reciprocal pump portion comprising: a first bellows which is made of a resin, and which is extendable and contractible in an axial direction in a casing that is disposed in one side portion of said pump head wall; an air cylinder portion which drives said first bellows so as to extend and contract; and a pump working chamber in which a check valve for sucking and a check valve for discharging are disposed inside said first bellows, said check valves being alternately opened and closed in accordance with the extending and contracting operations of said first bellows to suck and discharge the liquid; and a pulsation suppressing portion comprising: a second bellows which is made of a resin, which is disposed in a casing that is disposed in another side portion of said pump head wall, and which is extendable and contractible; a liquid chamber which is formed inside said second bellows, and which can temporarily store the liquid that is to be discharged from said pump working chamber via said discharge check valve; and an air chamber which is formed outside said second bellows to be isolated from said liquid chamber, and which is to be filled with air for suppressing pulsation, said pulsation suppressing portion causing pulsation due to a discharge pressure of the liquid which is discharged from said pump working chamber, to be absorbed by a change in a capacity of said liquid chamber due to the extending and contracting operations of said second bellows, wherein an extension rate of said second bellows is set to be larger than an extension rate of said first bellows.

2. A pump with a pulsation suppression device according to claim 1, wherein said first and second bellows are formed by a same resin material, and a thickness of said second bellows is smaller than a thickness of said first bellows.

3. A pump with a pulsation suppression device according to claim 1, wherein both of said first and second bellows are formed by polytetrafluoroethylene, and a thickness of said second bellows is smaller than a thickness of said first bellows.

4. A pump with a pulsation suppression device according to claim 1, wherein said reciprocal pump portion comprises a pair of first bellows.

5. A pump with a pulsation suppression device according to claim 2, wherein said reciprocal pump portion comprises a pair of first bellows.

6. A pump with a pulsation suppression device according to claim 3, wherein said reciprocal pump portion comprises a pair of first bellows.

7. A pump with a pulsation suppression device according to claim 3, wherein both of said first and second bellows are formed by polytetrafluoroethylene, and a thickness ratio (thickness of said second bellows/thickness of said first bellows) of said first and second bellows is smaller than 1.

8. A pump with a pulsation suppression device according to claim 7, wherein said reciprocal pump portion comprises a pair of first bellows.

* * * * *